United States Patent [19]

Makita et al.

[11] Patent Number: 4,507,376

[45] Date of Patent: Mar. 26, 1985

[54] ELECTROPHOTOGRAPHIC TONER COMPOSITION

[75] Inventors: Muneharu Makita, Takatsuki; Osamu Oseto, Suita; Toshiaki Munemitsu, Takatsuki, all of Japan

[73] Assignee: Arakawa Kagaku Kogyo Kabushiki Kaisha, Osaka, Japan

[21] Appl. No.: 514,020

[22] Filed: Jul. 15, 1983

[30] Foreign Application Priority Data

Jul. 23, 1982 [JP] Japan ..... 57-129280

[51] Int. Cl.[3] ..... G03G 9/08

[52] U.S. Cl. ..... 430/109; 430/904; 527/604

[58] Field of Search ..... 430/109, 904, 106; 527/604

[56] References Cited

U.S. PATENT DOCUMENTS 2,297,691 10/1942 Carlson ..... 430/31 X

*Primary Examiner*—John D. Welsh

*Attorney, Agent, or Firm*—Antonelli, Terry & Wands

[57] ABSTRACT

An electrophotographic toner composition having excellent blocking resistance and offset resistance which contains as a resin binder a polymeric rosin compound having a softening point of 50° to 190° C., a glass transition temperature of 10° to 170° C. and a molecular weight of 2,000 to 40,000 prepared by the reaction of (a) a glycidyl ester of rosin, (b) a dicarboxylic acid or its anhydride, and (c) a crosslinking agent selected from the group consisting of a polyfunctional epoxy compound, a polycarboxylic acid having a valency of not less than 3 or its anhydride, and a polyhydric alcohol having a valency of not less than 3. A dihydric alcohol may be used in the above reaction in order to improve the low temperature fixing property of the toner.

6 Claims, No Drawings

ELECTROPHOTOGRAPHIC TONER COMPOSITION

BACKGROUND OF THE INVENTION

The present invention relates to a toner composition for electrophotography, and more particularly to an electrophotographic toner composition having excellent blocking resistance and offset resistance which contains a rosin type polymeric compound as a binder.

Various electrophotographic methods are hitherto known. There is generally known a method in which a latent electrostatic image is formed on a photosensitive body utilizing a photoconductive material by various means and is then developed with a toner, and after transferring the toner image to a support such as paper if necessary, the toner image is fixed by heating, applying a pressure or using a solvent.

In recent years, a high speed fixing property is required for the toner in order to increase the efficiency of the copying operation. Attempts such as using a thermoplastic resin having a lower softening point and being easily heat fusible as a toner binder to be used in a conventional heat fixing method have been made to provide a toner composition satisfying the requirement. However, mere lowering of the softening point of a resin binder has the defect of causing agglomeration of toner particles, namely blocking phenomenon, during use. Accordingly, as one system for high speed fixing, there has been utilized a fixing method using a heat roller having a good heat conductivity.

Since the heat roller system is higher in heat efficiency than the heat fixing system, a toner can be fixed in a shortened period of time. However, sticking of the toner to the heat roller, namely the so-called offset phenomenon, frequently occurs, since the toner is directly brought into contact with the heat roller. Accordingly, it has been desired to develop a resin capable of solving this problem.

A styrene-acrylate copolymer, a styrene-butadiene copolymer and a styrene-acrylonitrile copolymer are usually known as a resin binder for a toner. These vinyl copolymers are in general poor in offset resistance and flowability. One of other resin binders is a bisphenol type epoxy resin. The bisphenol type epoxy resin provides a toner having superior flowability and fixing property because of having a lower molecular weight as compared with the vinyl copolymer binder. But, it has a tendency to lowering the offset resistance, because the melt viscosity of the resin is low. Also, various polyester resins are proposed as toner binders having excellent offset resistance and flowability.

It is an object of the present invention to provide a novel resin binder for a toner used in electrophotography having excellent blocking resistance, offset resistance and low temperature flowability.

A further object of the invention is to provide an electrophotographic toner composition having excellent blocking resistance, offset resistance and low temperature flowability.

These and other objects of the present invention will become apparent from the description hereinafter.

SUMMARY OF THE INVENTION

In accordance with the present invention, there is provided a toner composition for electrophotography comprising a resin binder and a colorant, said resin binder being a polymeric rosin compound having a softening point of 50° to 190° C., a glass transition temperature of 10° to 170° C. and a molecular weight of 2,000 to 40,000 and being prepared by the reaction of:

(a) a glycidyl ester of rosin, (b) a dicarboxylic acid or a dicarboxylic acid anhydride, and (c) at least one crosslinking agent selected from the group consisting of a polyfunctional epoxy compound, a polybasic acid having a valency of not less than 3 and its anhydride, and a polyhydric alcohol having a valency of not less than 3.

DETAILED DESCRIPTION

The glycidyl ester of rosin (a) used in the present invention can be prepared by reacting rosin and an epihalohydrin in the presence of a basic compound such as an organic amine with heating. Examples of the rosin are, for instance, natural rosins such as gum rosin, wood rosin and tall oil rosin, and modified rosins obtained by modifying the natural rosins such as hydrogenated rosin and disproportionated rosin. Abietic acid, dehydroabietic acid, dihydroabietic acid, pimaric acid and isopimaric acid which are effective components of rosin, are also employed in the invention. Tertiary amines and onium salts thereof are preferred as the above-mentioned organic amines. Typical examples of the tertiary amines are triethylamine, dimethylbenzylamine, methyldibenzylamine, tribenzylamine, dimethylaniline, dimethylcyclohexylamine, methyldicyclohexylamine, tripropylamine, tributylamine, N-phenylmorpholine, N-methylpiperidine and pyridine. Typical examples of the onium salts of tertiary amines are tetramethylammonium chloride, tetramethylammonium bromide, benzyltriethylammonium chloride, allyltriethylammonium bromide, tetrabutylammonium chloride, methyltrioctylammonium chloride, trimethylamine hydrochloride, triethylamine hydrochloride and pyridine hydrochloride.

The dicarboxylic acid and dicarboxylic acid anhydride (b) (these compounds being hereinafter referred to as "dicarboxylic acid compound") used in the present invention include, for instance, orthophthalic acid, isophthalic acid, terephthalic acid, endomethylenetetrahydrophthalic acid, tetrahydrophthalic acid, methyltetrahydrophthalic acid, hexahydrophthalic acid, methylhexahydrophthalic acid, maleic acid, fumaric acid, succinic acid, adipic acid, azelaic acid, sebacic acid, alkenylsuccinic acids having 8 to 18 carbon atoms, alkylsuccinic acids having 8 to 18 carbon atoms, and anhydrides thereof.

At least one of a polyfunctional epoxy compound, a polybasic acid having a valency of not less than 3, an anhydride of the polybasic acid and a polyhydric alcohol having a valency of not less than 3 is employed as a crosslinking agent (c) in the present invention.

Typical examples of the polyfunctional epoxy compound are an epoxy resin obtained by condensation of bisphenol A and an epihalohydrin, and rosin diepoxide or rosin triepoxide which is a reaction product of acrylic acid-modified rosin or fumaric acid-modified rosin with an epihalohydrin. In the preparation of the above-mentioned polyepoxides, rosin as used in the preparation of the rosin glycidyl ester can be used.

Typical examples of the polybasic acid having a valency of not less than 3 and the anhydride thereof are polycarboxylic acids such as trimellitic acid and pyromellitic acid, and the anhydrides thereof.

Typical examples of the polyhydric alcohol having a valency of not less than 3 are glycerol, trimethylolethane, trimethylolpropane and pentaerythritol.

The polymeric rosin compound used as a binder in the present invention is prepared, for instance, by a process in which the rosin glycidyl ester (a), the dicarboxylic acid compound (b) and the crosslinking agent (c) are charged at once, and reacted with heating in the presence or absence of the above-mentioned organic amine as a catalyst, or a process in which the rosin glycidyl ester (a) and the dicarboxylic acid compound (b) are reacted with heating in the presence or absence of the organic amine, the crosslinking agent (c) is then added in the course of or after the completion of the above reaction, and the reaction is further continued with heating.

The ratio of the rosin glycidyl ester (a) to the dicarboxylic acid compound (b) is from 1.5:1.0 to 1.0:1.5 by mole, preferably 1:1 by mole.

The amount of the crosslinking agent (c) should be carefully determined, since it has a great influence on the physical properties of the obtained binder resin, especially on the molecular weight and the molecular weight distribution. In case of using the polyfunctional epoxy compound as a crosslinking agent, the amount thereof is determined in consideration of the number of functional groups, namely the epoxy equivalent. For instance, triglycidyl ester of fumaric acid-modified rosin is employed in an amount of 0.005 to 0.07 mole, preferably 0.005 to 0.04 mole, per mole of the total of the rosin glycidyl ester (a) and the dicarboxylic acid compound (b). A bisphenol type epoxy resin which is commercially available, is employed in an amount of 0.005 to 0.14 mole, preferably 0.005 to 0.07 mole, per mole of the total of the ingredients (a) and (b). The amounts of the polybasic acid or its anhydride and the polyhydric alcohol are also determined in consideration of the number of functional groups thereof. For instance, in case that they are trivalent compounds, they are employed in an amount of 0.005 to 0.3 mole, preferably 0.005 to 0.15 mole, per mole of the total of the rosin glycidyl ester (a) and the dicarboxylic acid compound (b).

It is not always necessary to conduct the reaction in the presence of the organic amine catalyst. The catalyst may be employed depending on the kind of the used dicarboxylic acid compound for the purpose of shortening the reaction time. The catalyst is employed in an amount of 0.01 to 5% by weight, preferably 0.05 to 1% by weight, based on the rosin glycidyl ester (a).

Although the polymeric rosin compound used as a binder resin can be obtained in a good yield regardless of the presence or absence of a solvent, a solvent may be employed to smoothly remove the produced water outside the reaction system. The solvent is selected in consideration of the azeotropic property with water and the nonreactivity to the ingredients (a), (b) and (c). Typical examples of the solvent are toluene and xylene.

The reaction temperature and the reaction time are suitably determined in consideration of the yield of the product. The reaction time is usually selected from 0.5 to 10 hours, especially 1 to 8 hours. In case of using the dicarboxylic acid anhydride as an ingredient (b), the reaction temperature is usually selected from 100° to 250° C., especially 130° to 180° C. In case of using the dicarboxylic acid as an ingredient (b), the reaction time is usually selected from 150° to 300° C., especially 180° to 260° C. Also, in case that a solvent has been employed upon the reaction, the product can be obtained as a solid by distilling away the solvent under reduced pressure. The end point of the reaction can be easily determined, for instance, by measuring the acid value or by measuring the molecular weight distribution by means of gel permeation chromatography. The product, namely the polymeric rosin compound used as a binder, is completely soluble in a solubent such as xylene, and accordingly a gel fraction of the product to xylene as represented by the percentage of the portion insoluble in xylene of the product is substantially 0% by weight.

The polymeric rosin compound used as a binder for a toner in the present invention can be obtained in high yields by the process as mentioned above. From the viewpoints of the characteristics required for an electrophotographic toner composition such as blocking resistance, offset resistance and low temperature flowability, it is desirable that the polymeric rosin compound has a softening point of 50° to 190° C., a glass transition temperature of 10° to 170° C. and a number average molecular weight of 2,000 to 40,000. When the softening point of the binder is less than 50° C., the toner is poor in offset resistance, and when the softening point is more than 190° C., the toner is poor in low temperature flowability. When the glass transition temperature is less than 10° C., the offset resistance and the low temperature flowability are poor. Also, when the number average molecular weight is less than 2,000, the blocking resistance and the offset resistance are poor, and when the number average molecular weight is more than 40,000, the low temperature flowability is poor.

The molecular weight distribution of the polymeric rosin compound used as a binder is not particularly limited, but it is desirable that the molecular weight distribution is usually within the range of 1.5 to 50, because it has an influence on the offset resistance and the low temperature flowability.

A dihydric alcohol may be employed in the reaction of the ingredients (a), (b) and (c) in order to control the glass transition temperature of the obtained polymeric rosin compound, thus improving the fixing property of a toner composition at low temperatures. The dihydric alcohols used in the present invention are not particularly limited. Representative examples of the dihydric alcohols are, for instance, ethylene glycol, diethylene glycol, triethylene glycol, propylene glycol, 1,2-butanediol, 1,3-butanediol, 1,4-butanediol, bisphenol A, hydrogenated bisphenol A, ethoxy-substituted bisphenol A and propoxy-substituted bisphenol A. The amount of the dihydric alcohol is suitably determined in consideration of the glass transition temperature of the obtained polymeric rosin compound. Usually, up to 70% by mole, especially 1 to 70% by mole, more especially 20 to 70% by mole, of the rosin glycidyl ester to be used can be replaced with the dihydric alcohol.

Conventially known colorants can be employed in the present invention, e.g. carbon black, nigrosine dye, aniline blue, Calco Oil Blue, chrome yellow, ultra marine blue, Quinoline Yellow, methylene blue chloride, phthalocyanine blue, Malachite Green Oxalate, lamp black, Rose Bengal and Monastral Red. The colorant should be present in the toner composition in an amount sufficient to render it colored so that it will form a clearly visible image on a recording member. The colorant is employed usually in an amount of 1 to 20% by weight based on the total weight of the toner composition.

Known carrier materials such as magnetic substances can be employed for the toner composition of the present invention. Typical carriers include, for instance, a metal powder such as iron, steel, manganese, nickel, cobalt and chromium, an iron alloy such as ferrite and magnetite, an alloy or compound of a metal such as cobalt, nickel or manganese, and known ferromagnetic substances.

The present invention is more specifically described and explained by means of the following Examples. It is to be understood that the present invention is not limited to the Examples, and various changes and modifications may be made in the invention without departing from the spirit and scope thereof.

The following Reference Examples are presented to illustrate the preparation of rosin glycidyl esters and the preparation of a rosin epoxide crosslinking agent as used in the present invention.

REFERENCE EXAMPLE 1

A glycidyl ester of disproportionated rosin was prepared as follows: A 500 ml. flask equipped with a stirrer and a reflux condenser was charged with 100 g. of disproportionated rosin (acid value: 162, softening point: 79° C.) having a purity of 87% (the residual 13% portion being non-hydrolysate), 200 g. of epichlorohydrin and 0.1 g. of benzyltrimethylammonium chloride. The reaction was carried out at 80° C. for 4 hours. To the flask was added 16 g. of particulate sodium hydroxide by instalments. The temperature was elevated to 100° C. and the reaction was further continued at 100° C. for 2 hours. The deposited sodium chloride was filtered, and the unreacted epichlorohydrin was distilled away from the filtrate by a rotary evaporator. Further, a volatile material was completely removed at 120° C. and 2 mmHg to give an oily light yellow product (yield 97.2%). The thus obtained rosin glycidyl ester had an acid value of 0 and an epoxy equivalent of 425. The purity calculated on the basis of the epoxy equivalent was 84%.

REFERENCE EXAMPLES 2 TO 4

The procedure of Reference Example 1 was repeated except that, instead of the disproportionated rosin, there was employed gum rosin having a purity of 91%, an acid value of 169 and softening point of 75° C. (Reference Example 2), hydrogenated rosin having a purity of 89%, an acid value of 165 and a softening point of 74° C. (Reference Example 3) or tall oil rosin having a purity of 87%, an acid value of 163 and a softening point of 73° C. (Reference Example 4).

The rosin glycidyl ester obtained in Reference Example 2 had an acid value of 0, an epoxy equivalent of 436.5 and a purity of 82.1%. The rosin glycidyl ester obtained in Reference Example 3 had an acid value of 0, an epoxy equivalent of 431.6 and a purity of 83.5%. The rosin glycidyl ester obtained in Reference Example 4 had an acid value of 0, an epoxy equivalent of 445.5 and a purity of 80.0%.

REFERENCE EXAMPLE 5

A triglycidyl ester of fumaric acid-modified rosin usable as a crosslinking agent in the present invention was prepared as follows: In a nitrogen stream, 300 g. of gum rosin having a purity of 91%, an acid value of 169 and a softening point of 75° C. was molten at a temperature of 140° to 160° C. After adding 116 g. of crystalline fumaric acid thereto, the mixture was heated to a temperature of 200° to 220° C. and was reacted at that temperature for 2 hours with agitation to give fumaric acid-modified rosin.

A flask was charged with 100 g. of the fumaric acid-modified rosin, 500 g. of epichlorohydrin and 0.1 g. of benzyltrimethylammonium chloride, and the reaction was carried out at 80° C. for 4 hours. To the flask was added 28.8 g. of particulate sodium hydroxide by instalments. The temperature was elevated to 110° C., and the reaction was further continued at 110° C. for 2 hours under reflux, while removing the produced water by a trap. The deposited sodium chloride was filtered, and the unreacted epichlorohydrin was distilled away from the filtrate at 120° C. and 2 mmHg to give a balsam-like triglycidyl ester of fumaric acid-modified rosin. The product had an acid value of 0 and an epoxy equivalent of 337.

EXAMPLE 1

A flask was charged with 85.2 g. of the glycidyl ester of disproportionated rosin obtained in Reference Example 1, 34 g. of phthalic anhydride and 5.9 g. of the triglycidyl ester of fumaric acid-modified rosin obtained as a crosslinking agent in Reference Example 5. The reaction was carried out at 180° C. for 3 hours in a nitrogen stream. The end point of the reaction was determined by measuring the acid value and confirming by gel permeation chromatography that no unreacted starting materials were detected.

The obtained resin had a softening point of 128° C., a glass transition temperature of 77° C. and a number average molecular weight of 4,253. The molecular weight distribution was 5.5.

EXAMPLES 2 AND 3

The procedures of Example 1 were repeated except that 38.2 g. of methylhexahydrophthalic anhydride (Example 2) and 61.2 g. of dodecenylsuccinic anhydride (Example 3) which was a maleinization product of propylene tetramer or butylene trimer, were employed, respectively, instead of 34 g. of phthalic anhydride, to give light yellow resins. The properties thereof are shown in Table 1.

EXAMPLE 4

In a nitrogen stream, 94.8 g. of hydrogenated rosin glycidyl ester obtained in Reference Example 3, 29.6 g. of phthalic anhydride and 0.17 g. of benzyltrimethylammonium chloride were reacted at 180° C. for 3 hours. To the reaction mixture was added 10.7 g. of trimellitic anhydride, and the reaction was further conducted at 250° C. for 5 hours to give a light yellow resin. The properties of the resin are shown in Table 1.

EXAMPLE 5

The procedure of Example 1 was repeated except that 6.6 g. of a commercially available bisphenol A type liquid epoxy resin (commercial name "YD-115" made by Toto Kasei Kabushiki Kaisha, epoxy equivalent: 180 to 194) was employed instead of 5.9 g. of fumaric acid-modified rosin glycidyl ester used as a crosslinking agent, to give a light yellow resin. The properties of the resin are shown in Table 1.

EXAMPLE 6

A flask was charged with 89 g. of the tall oil rosin glycidyl ester obtained in Reference Example 4, 33.2 g. of isophthalic acid and 2.3 g. of trimellitic anhydride.

The temperature was elevated to 250° C., and the reaction was carried out at that temperature for 5 hours, while removing the produced water. The properties of the obtained light yellow resin are shown in Table 1.

EXAMPLE 7

A light yellow resin was prepared by reacting 87.2 g. of gum rosin glycidyl ester, 33.5 g. of adipic acid and 7.3 g. of fumaric acid-modified rosin glycidyl ester in the same manner as in Example 6. The properties of the resin are shown in Table 1.

EXAMPLE 8

A flask was charged with 50 g. of the disproportionated rosin glycidyl ester and 29.6 g. of phthalic anhydride. After reacting them at a temperature of 160° to 180° C. for 2 hours, 5.5 g. of glycerol was added to the flask and the reaction was further continued at 240° C. for 3 hours, while removing the produced water, to give a light yellow resin. The properties of the resin are shown in Table 1.

COMPARATIVE EXAMPLE 1

The procedure of Example 1 was repeated except that no crosslinking agent was employed, to give a light yellow resin. The properties of the resin are shown in Table 1.

COMPARATIVE EXAMPLE 2

In the preparation of a toner composition mentioned after, a copolymer of 70% by mole of styrene and 30% by mole of butyl methacrylate was employed as a resin binder. The properties of the styrene-methacrylate copolymer are shown in Table 1.

EXAMPLE 9

A flask was charged with 425 g. of the disproportionated rosin glycidyl ester, 232.8 g. of phthalic anhydride and 86 g. of triethylene glycol. The reaction was carried out at 240° C. for 4 hours in a nitrogen stream. After confirming that the acid value was about 10, 14.9 g. of trimellitic anhydride was added to the flask and the reaction was further continued. The reaction was stopped by confirming by gel permeation chromatography that the molecular weight reached the prescribed molecular weight. The obtained resin had a softening point of 126° C., a glass transition temperature of 72° C. and a number average molecular weight of 4,350. The molecular weight distribution was 32.

EXAMPLE 10

The procedure of Example 9 was repeated except that the kinds and the amounts of the starting materials were charged as shown in Table 2. The properties of the obtained resin are shown in Table 2.

EXAMPLE 11

In a nitrogen stream, 425 g. of the disproportionated rosin glycidyl ester and 114 g. of bisphenol A were reacted at 180° C. for 2 hours. After confirming by gel permeation chromatography that no peak for bisphenol A appeared, 133.2 g. of dodecenylsuccinic anhydride was added to the flask and the reaction was conducted at 240° C. for 3 hours. After the acid value of the product became about 10, 18.0 g. of the fumaric acid-modified rosin glycidyl ester obtained as a crosslinking agent in Reference Example 5 was added to the flask, and the reaction was further continued till reaching the prescribed molecular weight. The properties of the obtained resin are shown in Table 2.

EXAMPLE 12

The procedure of Example 11 was repeated except that the kinds and amounts of the starting materials were changed as shown in Table 2. The properties of the obtained resin are shown in Table 2.

EXAMPLES 13 TO 16

The procedures of Example 9 were repeated except that the kinds and amounts of the starting materials were changed as shown in Table 2. The properties of the obtained resins are shown in Table 2.

TABLE 1

| | Starting material | | | Number average molecular weight | Molecular weight distribution | Softening point (°C.) | Glass transition temperature (°C.) |
|---|---|---|---|---|---|---|---|
| | Glycidyl ester | Dicarboxylic acid compound | Crosslinking agent | | | | |
| Ex. 1 | Ref. Ex. 1 | Phthalic anhydride | Ref. Ex. 5 | 4253 | 5.5 | 128 | 77 |
| Ex. 2 | Ref. Ex. 1 | Hexahydrophthalic anhydride | Ref. Ex. 5 | 4320 | 6.2 | 125 | 78 |
| Ex. 3 | Ref. Ex. 2 | Dodecenylsuccinic anhydride | Ref. Ex. 5 | 5920 | 7.3 | 97 | 50 |
| Ex. 4 | Ref. Ex. 3 | Phthalic anhydride | Trimellitic anhydride | 26320 | 13.9 | 142 | 105 |
| Ex. 5 | Ref. Ex. 1 | Phthalic anhydride | Epoxy resin | 4680 | 5.1 | 111 | 72 |
| Ex. 6 | Ref. Ex. 4 | Isophthalic acid | Trimellitic anhydride | 5380 | 6.5 | 123 | 86.4 |
| Ex. 7 | Ref. Ex. 2 | Adipic acid | Ref. Ex. 5 | 12090 | 10.5 | 135 | 92 |
| Ex. 8 | Ref. Ex. 1 | Phthalic anhydride | Glycerol | 3920 | 7.2 | 120 | 78.4 |
| Com. Ex. 1 | Ref. Ex. 1 | Phthalic anhydride | — | 1926 | 1.6 | 76 | 43 |
| Com. Ex. 2 | (Styrene-butyl methacrylate copolymer) | | | 11000 | 6.2 | 130 | 65 |

TABLE 2

| | Starting material (g.) |
|---|---|

TABLE 2-continued

| | Glycidyl ester | Dicarboxylic acid compound | Crossliking agent | Dihydric alcohol |
|---|---|---|---|---|
| Ex. 9 | Ref. Ex. 1 (425) | Phthalic anhydride (232.8) | Trimellitic anhydride (14.9) | Triethylene glycol (86) |
| Ex. 10 | Ref. Ex. 1 (425) | Hexahydrophthalic anhydride (242.3) | Trimellitic anhydride (15.0) | Triethylene glycol (86) |
| Ex. 11 | Ref. Ex. 2 (425) | Dodecenylsuccinic anhydride (133.2) | Ref. Ex. 5 (18.0) | Bisphenol A (114.1) |
| Ex. 12 | Ref. Ex. 3 (297.5) | Phthalic anhydride (74) | Trimellitic anhydride (13.8) | Bisphenol A/triethylene glycol (114.1/45) |
| Ex. 13 | Ref. Ex. 1 (212.5) | Terephthalic acid (166.1) | Epoxy resin (17.2) | Neopentyl glycol (60) |
| Ex. 14 | Ref. Ex. 4 (212.5) | Isophthalic acid (166.1) | Trimellitic anhydride (13.2) | Neopentyl glycol/triethylene glycol (31.2/30.0) |
| Ex. 15 | Ref. Ex. 2 (297.5) | Adipic acid/terephthalic acid (29.2/132.8) | Ref. Ex. 5 (14.6) | Propoxy-substituted bisphenol A (120) |
| Ex. 16 | Ref. Ex. 1 (297.5) | Terephthalic acid (166.1) | Glycerol (26.2) | Bishydroxyethyl terephthalate (61.2) |

| | Number average molecular weight | Molecular weight distribution | Softening point (°C.) | Glass transition temperature (°C.) |
|---|---|---|---|---|
| Ex. 9 | 4350 | 32 | 126 | 72 |
| Ex. 10 | 26520 | 15 | 169 | 68 |
| Ex. 11 | 5860 | 21 | 133 | 75 |
| Ex. 12 | 4523 | 33 | 115 | 64 |
| Ex. 13 | 3260 | 18 | 139 | 76 |
| Ex. 14 | 2360 | 28 | 120 | 60 |
| Ex. 15 | 3360 | 29 | 131 | 63 |
| Ex. 16 | 4210 | 31 | 140 | 70 |

Toner compositions were prepared by employing as binders the resins obtained in Examples 1 to 16 and Comparative Examples 1 and 2 and the characteristics thereof were tested as follows.

After mixing 95 parts by weight of each of the resins obtained in the Examples and Comparative Examples and 5 parts by weight of carbon black by a ball mill, the mixture was kneaded by a heat roll and cooled. The mixture was then finely divided by a jet pulverizer to give a toner having an average particle size of 13 to 15 μm.

To 5 parts by weight of the toner was added 95 parts by weight of an iron powder carrier to give a developer. A latent electrostatic image was developed therewith by employing an electrophotographic copying machine, and it was transferred to and then fixed to a plain paper by employing a fixing roller having a polytetrafluoroethylene coated surface.

At that time, the temperature of the fixing roller was variously changed, and the fixing state of the toner was estimated. That is to say, a black ribbon image was fixed to a copy sheet by the above-mentioned method, and a cellophane adhesive tape was stuck thereto and immediately peeled off. The fixing property of the toner was estimated by light transmission of the tape.

The offset phenomenon, namely transferring of the fixed image to the roller, was then examined by bringing the fixing roller into contact with a new white paper under pressure immediately after fixing the toner image to a copy sheet, and observing the presence of the toner contamination on the white paper by the naked eye. The offset resistance was estimated according to the following criteria.

O: No offset

Δ: Slight offset

X: Large offset

The blocking resistance was estimated by applying 500 g. load to the toner, allowing to stand for 2 hours at a temperature within 50° to 65° C., observing the state of blocking and measuring the temperature at which blocking occurs.

The results are shown in Table 3.

TABLE 3

| | Temperature of blocking occurrence (°C.) | Offset resistance | | | Fixing property (%) | | |
|---|---|---|---|---|---|---|---|
| | | 170° C. | 200° C. | 240° C. | 150° C. | 170° C. | 200° C. |
| Ex. 1 | 60 | O | O | Δ | 85 | 92 | 98 |
| Ex. 2 | 60 | O | O | X | 83 | 91 | 99 |
| Ex. 3 | 55 | O | O | Δ | 88 | 90 | 98 |
| Ex. 4 | 65 | O | O | O | 80 | 88 | 98 |
| Ex. 5 | 60 | O | O | Δ | 84 | 92 | 99 |
| Ex. 6 | 60 | O | O | X | 80 | 93 | 98 |
| Ex. 7 | 65 | O | O | O | 82 | 94 | 98 |
| Ex. 8 | 60 | O | O | X | 81 | 89 | 96 |
| Ex. 9 | 65 | O | O | Δ | 83 | 92 | 98 |
| Ex. 10 | 60 | O | O | O | 80 | 87 | 98 |
| Ex. 11 | 65 | O | O | Δ | 88 | 91 | 99 |
| Ex. 12 | 55 | O | O | O | 86 | 92 | 99 |
| Ex. 13 | 65 | O | O | Δ | 89 | 92 | 98 |
| Ex. 14 | 55 | O | O | Δ | 88 | 91 | 99 |
| Ex. 15 | 60 | O | O | O | 84 | 86 | 98 |
| Ex. 16 | 65 | O | O | Δ | 89 | 90 | 99 |
| Com. | <50 | X | X | X | 12 | 20 | 35 |

TABLE 3-continued

| | Temperature of blocking occurrence (°C.) | Offset resistance | | | Fixing property (%) | | |
|---|---|---|---|---|---|---|---|
| | | 170° C. | 200° C. | 240° C. | 150° C. | 170° C. | 200° C. |
| Ex. 1 | | | | | | | |
| Com. Ex. 2 | 55 | O | X | X | 60 | 73 | 98 |

In addition to the ingredients used in the Examples, other ingredients can be used in the Examples as set forth in the specification to obtain substantially the same results.

What we claim is:

1. A toner composition for electrophotography comprising a resin binder and a colorant, said resin binder being a polymeric rosin compound having a softening point of 50° to 190° C., a glass transition temperature of 10° to 170° C. and a molecular weight of 2,000 to 40,000 and being prepared by the reaction of:

(a) a glycidyl ester of rosin, (b) a dicarboxylic acid or a dicarboxylic acid anhydride, and (c) at least one crosslinking agent selected from the group consisting of a polyfunctional epoxy compound, a polybasic acid having a valency of not less than 3 and its anhydride, and a polyhydric alcohol having a valency of not less than 3.

2. The composition of claim 1, wherein said polymeric rosin compound is prepared by the reaction of:

(a) a glycidyl ester of rosin, (b) a dicarboxylic acid or a dicarboxylic acid anhydride, (c) at least one crosslinking agent selected from the group consisting of a polyfunctional epoxy compound, a polybasic acid having a valency of not less than 3 and its anhydride, and a polyhydric alcohol having a valency of not less than 3, and (d) a dihydric alcohol.

3. The composition of claim 1, wherein the mole ratio of the rosin ester component (a) to the dicarboxylic acid component (b) is from 1.5:1.0 to 1.0:1.5.

4. The composition of claim 3, wherein said crosslinking agent is reacted with components (a) and (b) in an amount of 0.005 to 0.07 mole per mole of the total of the components (a) and (b) when crosslinking agent is a triglycidyl ester of of fumaric acid-modified rosin, and in an amount of 0.005 to 0.14 mole when the crosslinking agent is a bisphenol type epoxy resin.

5. The composition of claim 1, wherein components (a), (b) and (c) are reacted from a period from 0.5 to 10 hours at a temperature of 100° to 250° C. when the component (b) is a dicarboxylic acid anhydride and at 150° to 350° C. when the component (b) is a dicarboxylic acid.

6. The composition of claim 1, wherein said resin binder is completely soluble in xylene and the gel fraction thereof to xylene is substantially 0% by weight.

* * * * *